US006113214A

United States Patent [19]

Hirosawa et al.

[11] Patent Number: 6,113,214

[45] Date of Patent: Sep. 5, 2000

[54] INK JET RECORDING HEAD HAVING COMPONENTS MADE FROM THE SAME MATERIAL, RECORDING APPARATUS USING THE HEAD, AND METHOD FOR MANUFACTURING SUCH HEAD AND INK JET RECORDING APPARATUS

[75] Inventors: Toshiaki Hirosawa, Hiratsuka; Toru Yamane, Yokohama, both of Japan

[73] Assignee: Canon Kabushiki Kaisha, Tokyo, Japan

[21] Appl. No.: 08/657,077

[22] Filed: Jun. 3, 1996

[30] Foreign Application Priority Data

Jun. 8, 1995 [JP] Japan ..... 7-141606

[51] Int. Cl.[7] ..... B41J 2/155

[52] U.S. Cl. ..... 347/42

[58] Field of Search ..... 347/42, 20, 65, 347/68, 69, 71, 59, 50

[56] References Cited

U.S. PATENT DOCUMENTS

| | | | |
|---|---|---|---|
| 4,499,480 | 2/1985 | Takatori et al. | 347/42 |
| 4,663,640 | 5/1987 | Ikeda | 346/140 R |
| 4,970,532 | 11/1990 | Komuro et al. | 347/65 |
| 5,059,973 | 10/1991 | Watanabe | 346/1.1 |
| 5,164,747 | 11/1992 | Osada et al. | 346/140 R |
| 5,220,345 | 6/1993 | Hirosawa | 346/1.1 |
| 5,243,363 | 9/1993 | Koizumi et al. | 347/50 |
| 5,343,227 | 8/1994 | Hirosawa et al. | 349/42 |
| 5,451,989 | 9/1995 | Kadowaki et al. | 347/42 |

FOREIGN PATENT DOCUMENTS

| | | |
|---|---|---|
| 0347856 | 12/1989 | European Pat. Off. . |
| 0442706 | 8/1991 | European Pat. Off. . |
| 0602021 | 6/1994 | European Pat. Off. . |
| 0605006 | 7/1994 | European Pat. Off. . |
| 4-78539 | 3/1992 | Japan . |

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet recording head is provided with a recording element substrate having a plurality of discharge energy generating elements for generating energy utilized for discharging ink droplets, a ceiling plate arranged on the recording element substrate having an ink chamber formed to retain ink in the ink paths corresponding to the plurality of discharge energy generating elements, and a base plate for use of a recording element substrate to hold the recording element substrate. For this ink jet recording head, the recording element substrate, the ceiling plate, and the base plate are structured by the same material, thus preventing the substrate and plates from being damaged by warping, cracking, and other causes due to temperature changes or the like.

10 Claims, 6 Drawing Sheets

INK JET RECORDING HEAD HAVING COMPONENTS MADE FROM THE SAME MATERIAL, RECORDING APPARATUS USING THE HEAD, AND METHOD FOR MANUFACTURING SUCH HEAD AND INK JET RECORDING APPARATUS

BACKGROUND OF THE INVENTION

1. Field of the Invention

The present invention relates to an ink jet recording head, a method for manufacturing such head, and an ink jet recording apparatus. More particularly, the invention relates to an ink jet recording head formed by laminating a substrate having discharge energy generating elements and a plate having a liquid chamber retaining recording liquid (ink), and a method for manufacturing the head, and also, relates to an ink jet recording apparatus using such head.

2. Related Background Art

Conventionally, there are known various types of ink jet recording heads that discharge recording droplets from the discharge ports. For example, there is the one that discharges recording droplets by the application of pressure changes created in liquid paths by means of deformation of piezoelectric elements or the one in which a pair of electrodes are further provided in addition to the piezoelectric elements in order to cause the recording droplets to deflect, or the one that utilizes thermal energy for discharging recording droplets from the discharge ports by means of heat generating elements arranged in each of ink paths to generate heat rapidly, among others.

Of these types, the ink jet recording head that uses the method whereby to discharge recording droplets by utilization of thermal energy is given particular attention because, with this method, it is possible to record in high resolution with the arrangement of liquid discharge ports, such as orifices, in high density, which form flying droplets by discharging recording droplets, and to make the entire body compact as a recording head by the effective utilization of the IC technologies and micro-machining techniques whose technical advancement and reliability are enhanced significantly in the semiconductor industrial field in recent years, thus making the elongation and surfacing (two dimensional arrangement) of the head possible, among other advantages, and also, because it is easier to provide a multiple nozzle and implement a highly densified assembling at lower manufacturing costs resulting from the good productivity of the heads when fabricated on a large-scale production.

Usually, however, the recording head is formed by laminating and fixing the heater board, ceiling plate, and base plate, which are made of different materials. Particularly, for a recording head of a multiple type where the discharge energy generating elements are arranged in a number corresponding to the recording width of a recording medium, the head is subjected to warping, cracking, and other damages occurring due to difference in thermal expansion coefficient of each of the materials used for forming the head, which tends to produce adverse effects due to temperature changes or the like.

As a result, not only the image quality is degraded, but also, in some cases, a problem is encountered which destroys a recording head.

Also, the discharge ports of a head that discharge recording liquid are often produced by cutting or grinding the portion where discharge ports are formed after the heater board and the ceiling plate are adhesively bonded. Here, since the heater board and the ceiling are made by different materials having different machinability, it is difficult to process each of the surfaces smoothly to finish them uniformly flat without flash or the like.

SUMMARY OF THE INVENTION

The present invention is designed with a view to solving the problem described above. It is an object of the invention to provide an ink jet recording head for which no warping, cracking, and other damages are caused even when temperature changes, and a method for manufacturing the head, and to provide an ink jet recording apparatus using such head.

It is another object of the invention to provide an ink jet recording head provided with a recording element substrate having a plurality of discharge energy generating elements for generating energy utilized for discharging ink droplets, a ceiling plate arranged on the recording element substrate having an ink chamber formed to retain ink in the ink paths corresponding to the plurality of discharge energy generating elements, and a base plate for use of a recording element substrate to hold the recording element substrate, this ink jet recording head having the recording element substrate, the ceiling plate, and the base plate, being structured by the same material.

It is still another object of the invention to provide an ink jet recording head provided with a recording element substrate having a plurality of recording elements arranged thereon, a driving element substrate having driving elements arranged thereon to drive the recording elements, and a base plate for use of a driving element substrate to hold the driving element substrate, the recording element substrate and the driving element substrate being pressed to be in contact to electrically connect them, wherein the recording element substrate, the driving element substrate, and the base plate are structured by the same material.

It is a further object of the invention to provide a method for manufacturing an ink jet recording head comprising the steps of forming with one and the same material a recording element substrate having a plurality of discharge energy generating elements for generating energy utilized for discharging ink droplets, a ceiling plate arranged on the recording element substrate having an ink chamber formed to retain ink in the ink paths corresponding to the plurality of discharge energy generating elements, and a base plate for use of a recording element substrate to hold the recording element substrate; of laminating the base plate, the recording element substrate, and the ceiling plate so as to allow the ceiling plate and the base plate to nip the recording element substrate; and of forming the discharge ports to discharge ink by cutting the laminated base plate, recording element substrate and ceiling plate at a time.

It is still a further object of the invention to provide an ink jet recording apparatus comprising an ink jet recording head provided with a recording element substrate having a plurality of discharge energy generating elements for generating energy utilized for discharging ink droplets, a ceiling plate arranged on the recording element substrate having an ink chamber formed to retain ink in the ink paths corresponding to the plurality of discharge energy generating elements, and a base plate for use of a recording element substrate to hold the recording element substrate, this ink jet recording head having the recording element substrate, the ceiling plate, and the base plate, being structured by the same material; and a mounting unit to mount the ink jet recording head.

It is another object of the invention to provide an ink jet recording apparatus comprising an ink jet recording head provided with a recording element substrate having a plurality of recording elements arranged thereon, a driving element substrate having driving elements arranged thereon to drive the recording elements, and a base plate for use of a driving element substrate to hold the driving element substrate, the recording element substrate and the driving element substrate being pressed to be in contact to electrically connect the recording element substrate and the driving element substrate, this ink jet recording head having the recording element substrate, the driving element substrate, and the base plate being structured by the same material; and a mounting unit to mount the ink jet recording head.

With the recording element substrate, ceiling plate, and base plate for use of the recording element substrate, which are structured by one and the same material, it is possible to make the thermal expansion coefficients of these board and plates equal, and prevent them from being warped, cracked, or damaged by other causes due to temperature changes or the like.

Also, the recording element substrate, ceiling plate and base plate are laminated, and then, the portions where discharge ports are formed are cut together to produce the discharge ports as well as the discharge port formation surface. As a result, there are no steps being present on the discharge port surface formed by the recording element substrate, ceiling plate and base plate, hence making it easy to form the smooth and flat surface uniformly.

Also, the structure is formed by a recording element substrate having a plurality of recording elements arranged on it, a driving element substrate having driving elements arranged on it to drive the recording elements, and a base plate used for holding the driving element substrate, wherein the recording element substrate and the driving element substrate are pressed to be in contact to electrically connect them, and at the same time, the recording element substrate, the driving element substrate, and the base plate are made by the same material. Therefore, it is possible to improve the drawbacks of the electrical connection between these boards due to temperature changes or the like, such as being encountered in the conventional art.

Other objectives and advantages besides those discussed above will be apparent to those skilled in the art from the description of a preferred embodiment of the invention which follow. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, the description will be made of the embodiments in accordance with the present invention.

(Embodiment 1)

Figure 1:
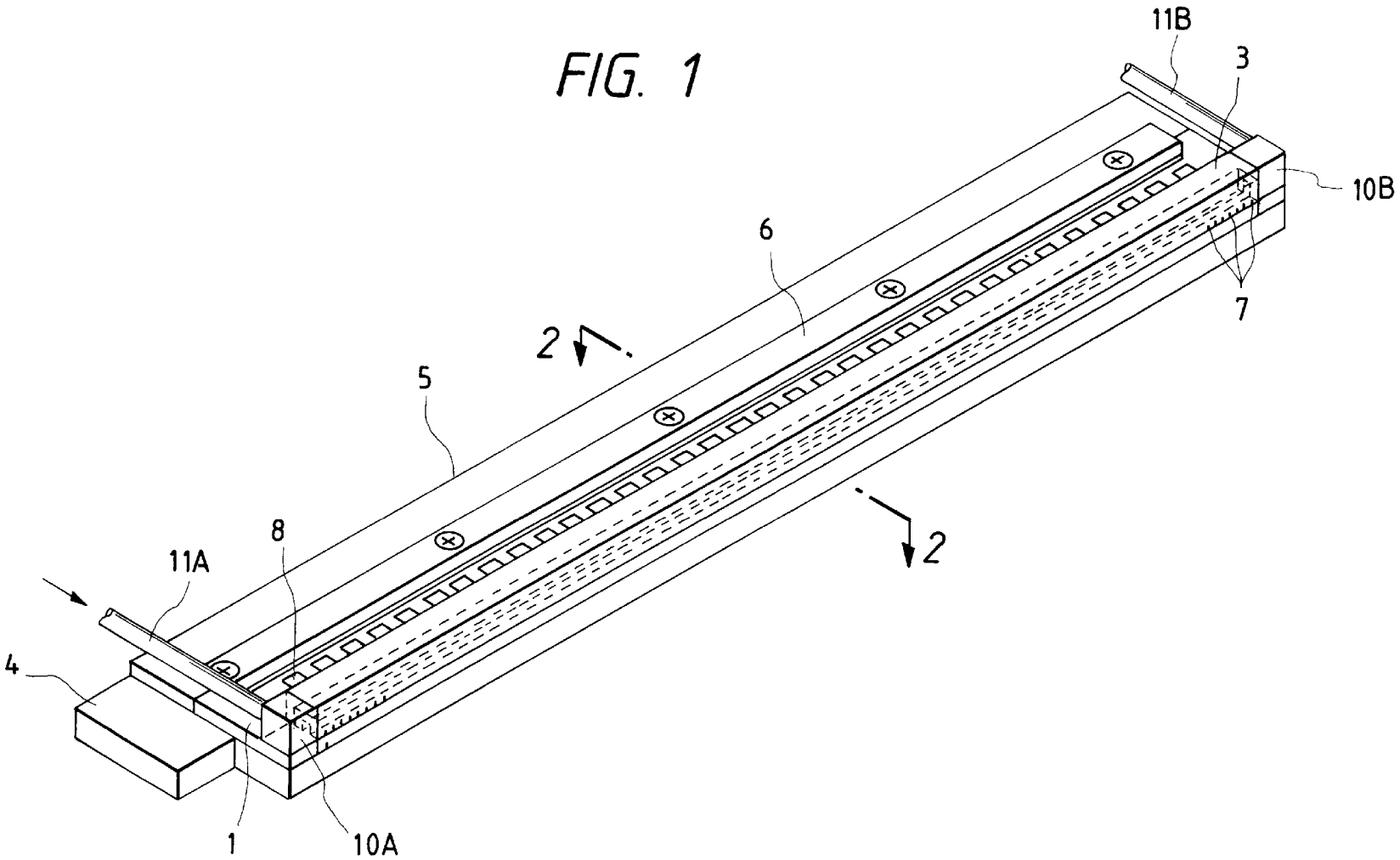
FIG. 1 is a perspective view which schematically shows an ink jet recording head in accordance with a first embodiment of the present invention.
Figure 2:
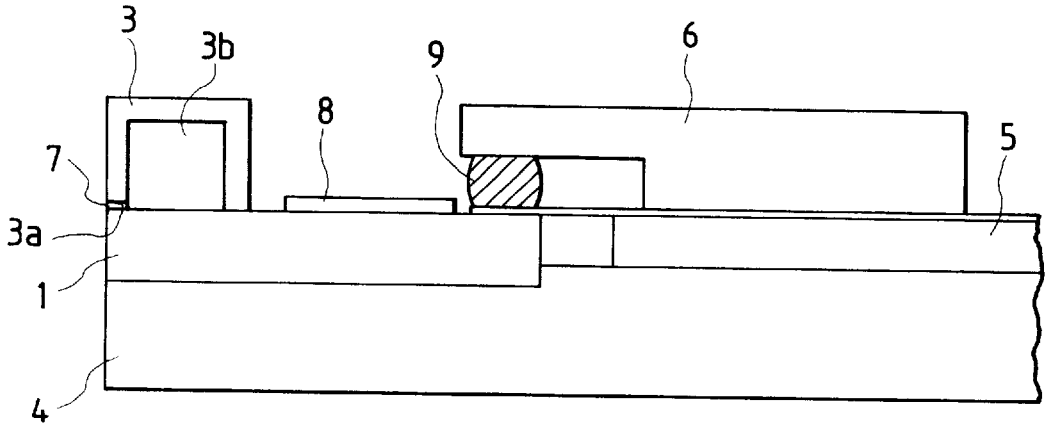
FIG. 2 is a cross-sectional view taken along line 2—2 in FIG. 1.

FIG. 1 and FIG. 2 are views showing the structure of an ink jet recording head that utilizes thermal energy, in accordance with an embodiment 1 of the present invention. FIG. 1 is a perspective view of its head. FIG. 2 is a cross-sectional view taken along line 2—2 in FIG. 1. This head is of the so-called full line type, having its discharge ports arranged over a length corresponding to one side of A4-sized recording sheet, for example.

In FIG. 1 and FIG. 2, a reference numeral 1 designates a heater board, that is, a recording element substrate on which electro-thermal transducing elements (discharge heaters) and wiring of Al or the like are formed (not shown) in order to supply electric power to the discharge heaters produced by film formation techniques, as well as driving elements 8 to drive the discharge heaters. A reference numeral 3 designates a ceiling plate having liquid paths 3*a* arranged corresponding to the discharge heaters, and a liquid chamber 3*b* formed as a recessed portion to supply ink to the liquid paths. For the ceiling plate 3, ink induction inlets 10A and 10B are provided to let in ink to the liquid chamber 3*b*. Here, reference numerals 11A and 11B designate ink supply tubes to supply ink to the head. The liquid chamber 3*b* and the ink induction inlets 10A and 10B are formed by cutting or by means of an etching mold formation. A reference numeral 4 designates a base plate, that is, a holding board for holding the heater board 1.

On the recording element substrate 1, the ceiling plate 3 is positioned and laminated, and the recording element substrate 1 is positioned and fixed to the base plate 4. A circuit board 5 for drawing electric power and electric signals from the outside for discharging ink is positioned exactly with respect to the electric connection pad of the recording element substrate 1. A pressure plate 6 is fixed to the base plate 4 by means of screws. Thus the recording element substrate and the base plate are pressed to be in contact with the inclusion of an elastic member 9.

In accordance with the present embodiment of the recording head, the recording element substrate 1, the ceiling plate 3, and the base plate 4 are all structured by the same material. For such material, aluminum (Al), stainless alloy (SUS), copper (Cu) or the like is preferably used. Of these materials, it is particularly preferable to use aluminum from the viewpoint of its heat radiation and machinability. Since one and the same material is used, the heat expansion coefficients of the recording element substrate 1, ceiling plate 3, and base plate 4 are all the same. As a result, there is no possibility that the board and plates are warped, cracked, or damaged by other causes due to temperature changes or the like. In this respect, aluminum and copper referred to in the specification hereof may contain other materials if only such materials reside in them at an impurity level.

(Embodiment 2)

Figure 4:
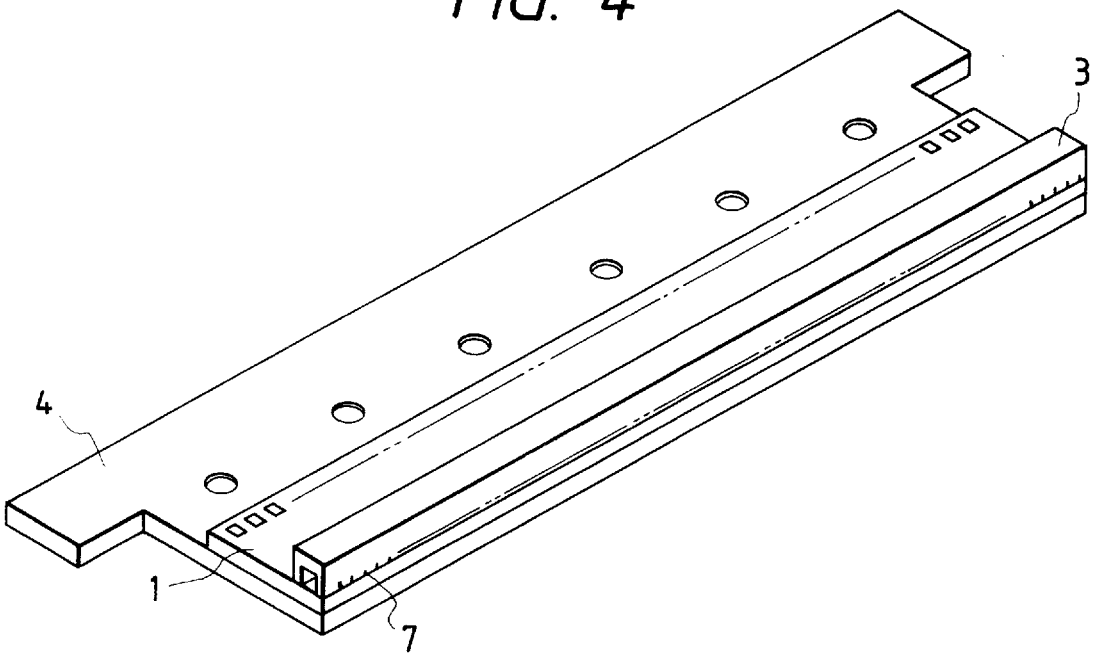
FIG. 4 is a perspective view which schematically shows the ink jet recording head manufactured by the method represented in FIG. 3.
Figure 3:
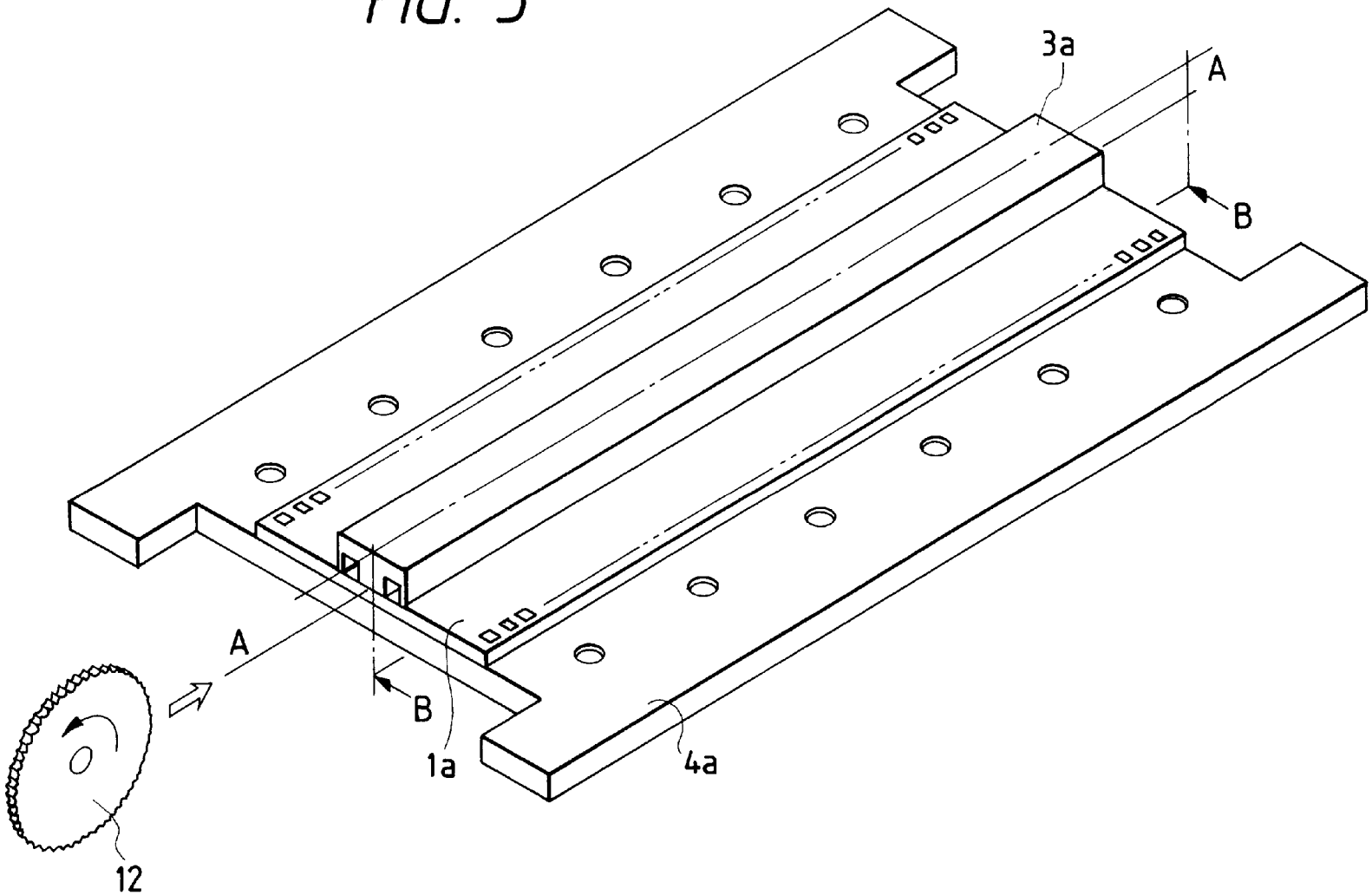
FIG. 3 is a perspective view which schematically illustrates a method for manufacturing an ink jet recording head in accordance with the present invention.

With reference to FIG. 3 and FIG. 4, the description will be made of a method for manufacturing an ink jet recording head in accordance with the present invention.

FIG. 3 is a perspective view which schematically shows a method for manufacturing a recording head. FIG. 4 is a perspective view which shows the outer appearance of a recording head manufactured by the method represented in FIG. 3.

This recording head is formed by laminating a recording element substrate la on which discharge. energy generating elements are arranged each on opposite sides, a ceiling plate 3 on which liquid chambers are formed on the opposite sides for the provision of ink supply to liquid paths corresponding to the discharge energy generating elements, and a base plate 4 for holding and fixing the recording element substrate 1. Then, as shown in FIG. 3, the recording head thus formed is cut by means of a blade 12 along the head facing axis A—A.

By means of this process, two heads are produced at a time, each being formed by the recording element substrate 1, ceiling plate 3, and base plate 4 to provide one body as shown in FIG. 4.

In accordance with the present embodiment, the recording element substrate 1, ceiling plate 3, and base plate 4, being made of a same material, aluminum, for example, are cut together. Therefore, no steps are created between the board and plates at all. Also, it is easy to form a smoothly cut uniform surface, that is, the discharge port surface provided with the discharge ports 7.

As a result, it is possible to minimize the adhesion of ink droplets to the discharge port surface. At the same time, it is possible to operate wiping or the like smoothly and effectively in order to remove ink droplets and dust particles adhering to the discharge port surface.

Figure 5:
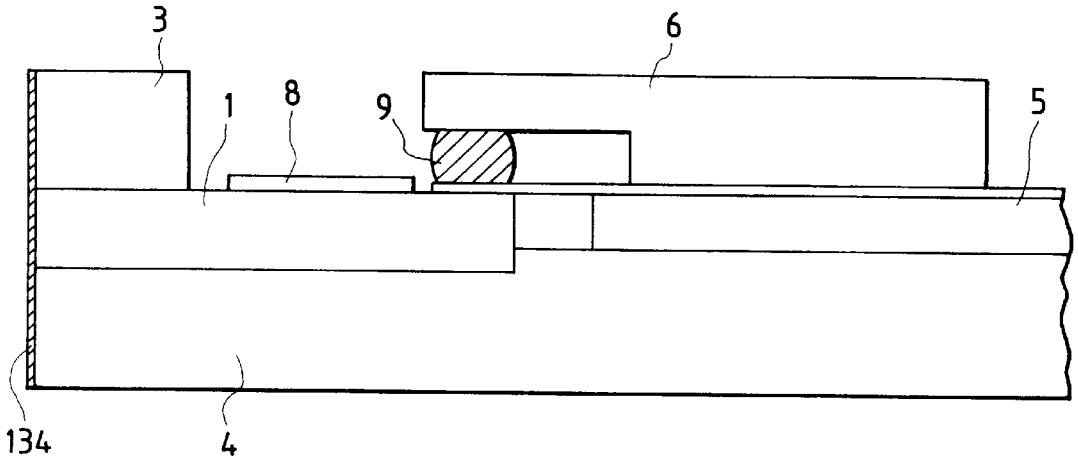
FIG. 5 is a side view which shows an ink jet recording head manufactured by another method for manufacturing an ink jet recording head in accordance with the present invention.

(Embodiment 3) With reference to FIG. 5, the description will be made of a method for manufacturing an ink jet recording head in accordance with another embodiment of the present invention. FIG. 5 is a side view showing a head.

The method of manufacture in accordance with the present embodiment is such that the discharge port surfaces of the recording element substrate 1, ceiling plate 3, and base plate 4 are coated with a same water repellent film 134 at a time.

In this case, the recording element substrate 1, ceiling plate 3, and base plate 4 are all formed by a same material, such as aluminum. Therefore, it is possible to provide a water repellent film uniformly using the water repellent film 134 whose close adhesiveness is made all the same. In this respect, for a head manufactured by the method in accordance with the embodiment 2, there are no steps created between the recording element substrate 1, the ceiling plate 3, and the base plate 4 as described above. Therefore, it is possible to coat and form the water repellent film 134 uniformly in a better condition.

(Embodiment 4)

Figure 6:
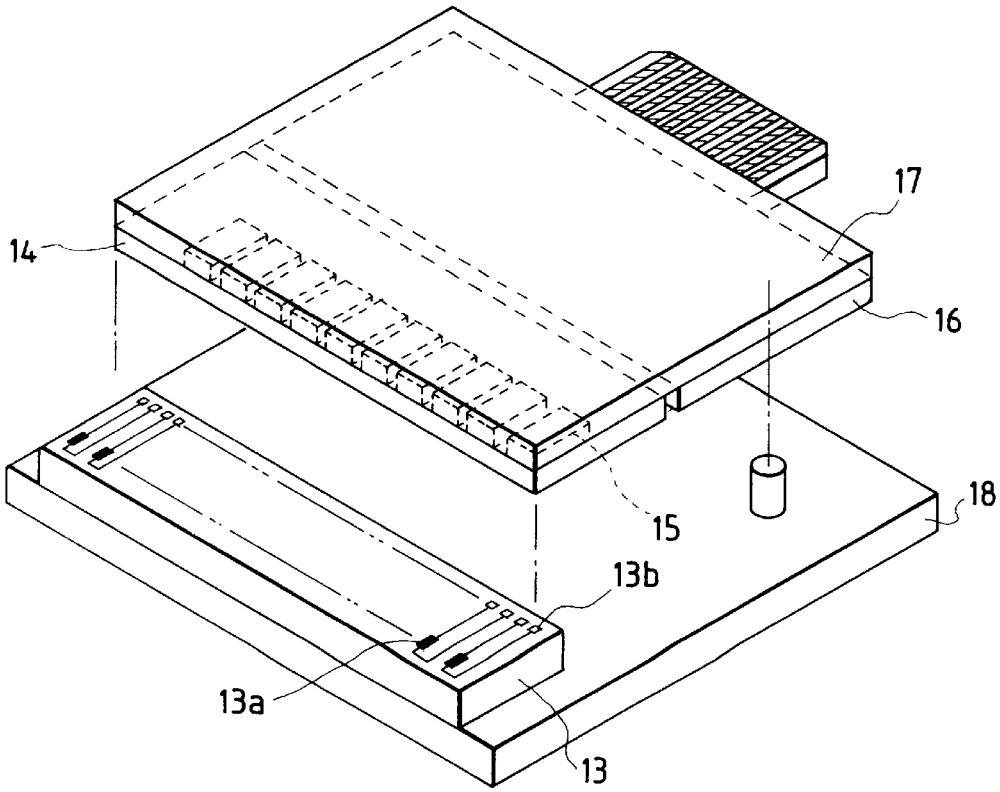
FIG. 6 is an exploded perspective view which shows an ink jet recording head in accordance with another embodiment of the present invention.

FIG. 6 is an exploded perspective view showing a recording head in accordance with an embodiment 4 of the present invention.

In FIG. 6, a reference numeral 13 designates a recording element substrate on which a plurality of recording elements (heaters) 13*a* are arranged, and also, there are formed a wiring unit connected with the recording elements, and connecting electrodes 13*b* provided for the end portion of the wiring unit; 14, a driving element substrate on which driving elements 15 are installed to drive the recording element substrate 13, and connecting electrodes are formed to electrically connect them with the recording element substrate 13; 16, a circuit board to receive electricity received from the outside and input it to the driving element substrate 14; 17, a base plate for use of a driving element substrate to hold and fix the driving element substrate 14 and the circuit board 16, here the driving element substrate 14 and circuit board 16 being connected electrically; and 18, a base plate for use of a recording element substrate to hold and fix the recording element substrate 13.

Then, the connecting electrodes of the recording element substrate 13 and the driving element substrate 14 are positioned themselves to face each other, and pressed to be in contact with each other by means of a pressure member (not shown). In this way, the electrical connection is made between the recording element substrate 13 and the driving element substrate 14. The connecting electrodes are arranged at intervals of several tens to several hundreds $\mu$m. Here, an exact positioning is required.

With respect to the structure arranged as described above in accordance with the present embodiment, the recording element substrate 13, driving element substrate 14, base plate 17, and base plate 18 are all formed by a same material, either one of Al, SUS, Cu, and the like, for example.

As a result, the thermal expansion coefficients of the recording element substrate 13, driving element substrate 14, base plate 17 and base plate 18 are all the same, thus preventing the boards and plates from being damaged by hence eliminating warping, cracking, and other causes due to temperature changes or the like. Also, it is possible to prevent the connecting electrodes of the recording element substrate 13 and driving element substrate 14 from being displaced due to difference in thermal expansion, thus enhancing the reliability of the pressure connection thereof.

(Embodiment 5)

Figure 7:
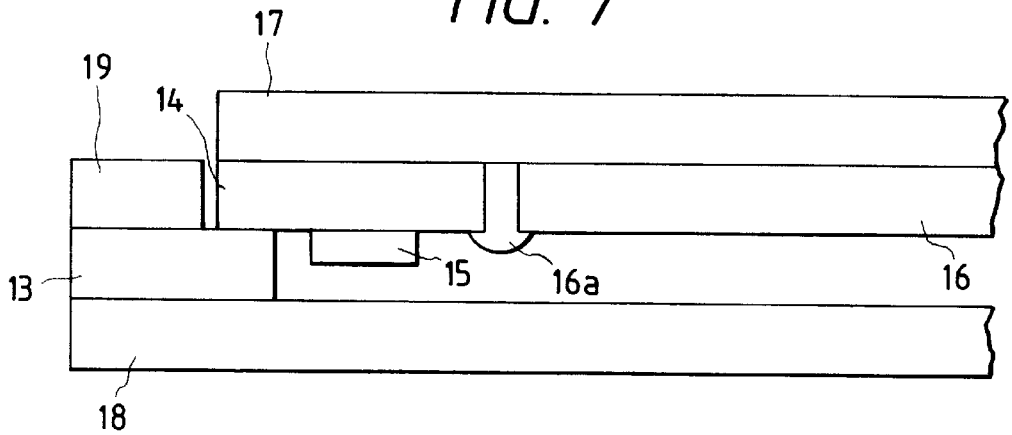
FIG. 7 is a side view which shows an ink jet recording head in accordance with another embodiment of the present invention.

FIG. 7 is a side view which schematically shows a recording head in accordance with an embodiment 5 of the present invention.

This recording head is an ink jet recording head for which the discharge ports for discharging ink and the ink paths are formed on its recording element substrate, and a ceiling plate is formed with a liquid chamber to supply ink to the ink paths.

Also, in the same manner as the embodiment 4, the recording element substrate 13, and the driving element substrate 14 having driving elements 15 arranged thereon are pressed to make the electrical connection. Here, the driving elements 15 are connected to the outer side of the head by means of wire bonding 16*a* through another board 16.

In accordance with the present embodiment, too, the recording element substrate 13, ceiling plate 19, driving element substrate 14, base plate 17 and base plate 18 are all structured by one and the same material, such as aluminum. Therefore, it is possible to prevent the ceiling plate 19 from being damaged by warping, deformation, or the like in addition to the effects obtainable by the arrangement as in the embodiment 4.

Also, it is possible to cut the recording element substrate 13, ceiling plate 19, and base plate 18 at a time. Therefore, workability is improved. At the same time, the uniform smoothness of the discharge port surface is obtained in a better condition.

(Embodiment 6)

In accordance with the present embodiment, the side walls of the ink paths of an ink jet recording head are formed by means of patterning with photosensitive resin, while the remaining portions thereof are structured in the same manner as the embodiment 1.

Figure 8:
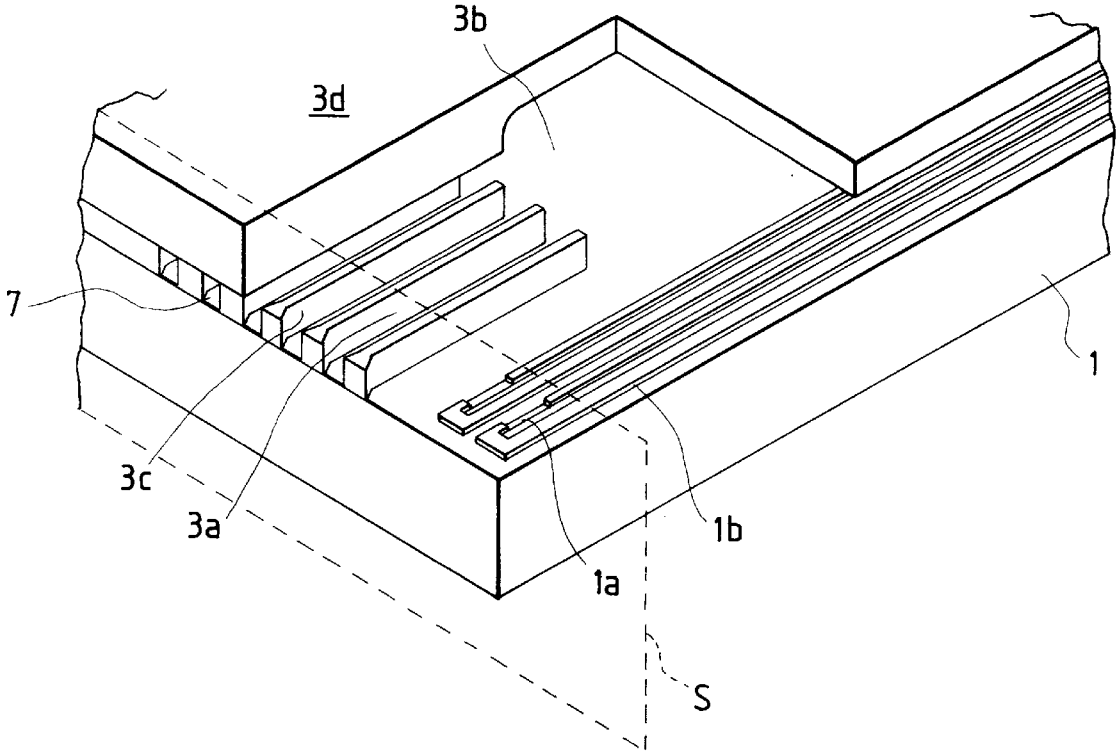
FIG. 8 is a partly broken perspective view which schematically shows the principal part of an ink jet recording head in accordance with another embodiment of the present invention.

FIG. 8 is a partly broken perspective view which schematically shows the principal part of the ink jet recording head as described above. Through the semiconductor fabrication steps, such as etching, deposition, and sputtering, electrothermal transducing elements 1*a* and electrodes 1*b* are arranged on the recording element substrate 1 by means of film formation. On the recording element substrate thus prepared, the walls of liquid paths are produced by patterning with photo-sensitive resin. Then, the ceiling plate 3*d* is bonded on them.

Liquid supplied to the common liquid chamber 3*b* is supplied into the liquid paths 3*a* by the application of the so-called capillary phenomenon and forms meniscus at the discharge ports 7 located at the leading end of the liquid paths. Hence the discharging liquid is held stably. A reference mark S designates the discharge port surface where a plurality of discharge ports are arranged. Here, when the electrothermal transducing elements are energized, the liquid on each electrothermal transducing element is heated rapidly to create an air bubble in the liquid path. By the development and contraction of such air bubble, liquid is discharged from the discharge port 7, thus forming a liquid droplet. With the structure described above, it is possible to form an ink jet recording head having 128 or 256 discharge ports in a discharge port density of 16 nozzles/mm or, further, having the multiple nozzles where the discharge ports are arranged to cover the entire recording width.

Figure 9:
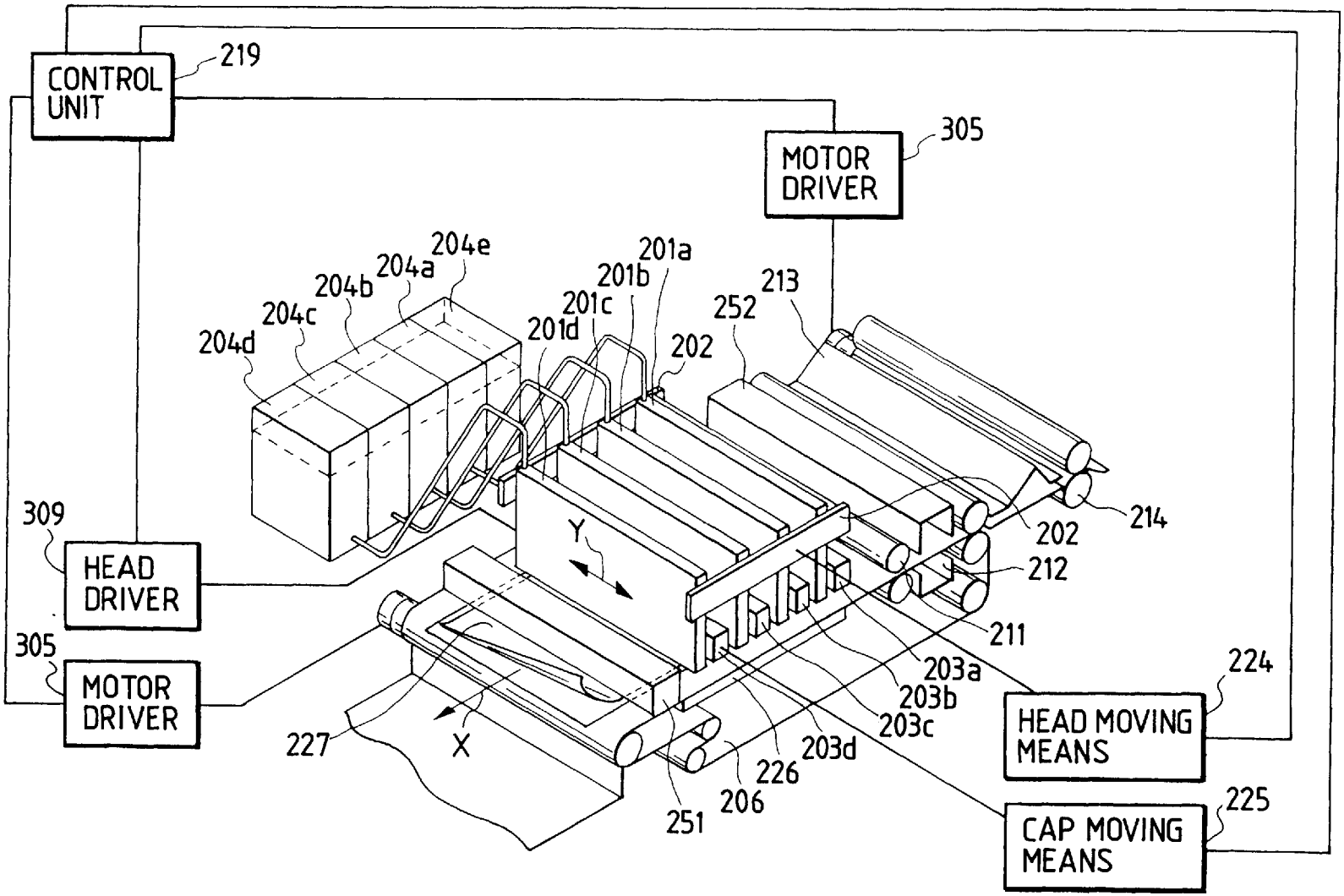
FIG. 9 is a perspective view which schematically shows the principal part of an ink jet recording apparatus using an ink jet recording head of the present invention.

FIG. 9 is a perspective view which schematically shows the principal part of an ink jet recording apparatus that uses the liquid discharge head 201 of the present invention. In accordance with the present embodiment, the liquid discharge head is of a full line type where a plurality of discharge ports are arranged in a length corresponding to the recordable width of a recording medium 227 at intervals of 360 dpi. Four heads for four colors, yellow (Y), magenta (M), cyan (C), and black (Bk), are fixed and supported in a holder 202 in parallel to each other at given intervals in the direction indicated by an arrow X in FIG. 9. To these heads, signals are supplied from the head drivers 309 that constitutes means for supplying driving signals. Each of the heads is driven in accordance with such signals, respectively.

To each of the heads, each of the four color ink, Y, M, C, and Bk, is supplied from each of the ink containers 204*a* to 204*d*. In this respect, a reference numeral 204*e* designates a foaming liquid container in which foaming liquid is stored, and structured to supply it from this container to each of the heads.

Also, head caps 203*a* to 203*d* are arranged below the heads, respectively. In each of the caps, an ink absorbent, such as sponge, is contained to cover the discharge ports of each head in order to protect it when recording is at rest.

A reference numeral 206 designates a carrier belt constituting feeding means for carrying a recording medium of various types described earlier. The carrier belt 206 is drawn around each kind of rollers in a given path, and driven by means of the driving rollers connected to a motor driver 305.

In accordance with the ink jet recording system of the present embodiment, a pre-processing equipment 251 and a post-processing equipment 252 are arranged, respectively, on the upstream side and downstream side of the recording medium feeding path in order to provide various processes required for the preparation of a recording medium before and after recording.

The process details of the pre-processing and post-processing are different depending on the kinds of recording media and the kinds of ink to be used for recording, but for such a recording medium as metal, plastic, or ceramics, ultraviolet rays and ozone are irradiated as pre-processing in order to activate the surface of the recording medium, thus enabling ink to enhance its adhesiveness. Also, if the recording medium is subjected to the generation of static electricity, such as plastic, dust particles easily adhere to the surface thereof because of the electrostatic generation. In some cases, recording does not show good results due to the adhesion of the dust particles. Therefore, as a pre-processing, it is advisable to use an ionizer for the removal of the static electricity from the recording medium to clear off the dust particles therefrom. Also, when fabrics are used as a recording medium, it is advisable to conduct a pre-processing in which a substance is selected from among alkali substance, water soluble substance, water soluble metallic salt, urea and thiourea, and the substance thus selected is applied to the fabrics with a view to preventing ink from spreading, and also, to enhancing the percentage exhaustion, among others. The pre-processing is not necessarily limited to those discussed above, but it may be possible to adopt a process whereby to arrange the temperature of a recording medium to be suitable for recording on such particular medium.

Meanwhile, the post-processing is to conduct a thermal process with respect to the recording medium to which ink has been given, a fixing process to promote the fixation of ink by means of irradiation of ultraviolet rays or the like, and a cleaning process to clean off the processing agents used for the preprocessing but still remaining inactive, among others.

As described above, in accordance with the present invention, it is easy to obtain and manufacture a highly reliable ink jet recording head capable of obtaining high quality images at all times by the provision of a uniformly smooth discharge port surface, which is not damaged by warping, cracking, or some other causes due to temperature changes or the like.

What is claimed is:

1. An ink jet recording head, comprising:

a recording element substrate having a plurality of recording elements and a plurality of connecting electrodes respectively connected to said recording elements, arranged on a surface thereof;

a driving element substrate having a plurality of driving elements to drive said recording elements and a plurality of connecting electrodes respectively connected to said driving elements, arranged on a surface thereof;

a ceiling plate having an ink chamber formed thereon to retain ink to be supplied to a plurality of ink paths conductively and respectively connected with a plurality of discharge ports for discharging ink, said ceiling plate being arranged on said recording element substrate;

a first base plate to hold said driving element substrate; and a second base plate to hold said recording element substrate, wherein said recording element substrate and said driving element substrate are pressed together such that said surface of said recording element substrate faces said surface of said driving element substrate, thereby connecting together in direct contact said connecting electrodes of said recording element substrate and said connecting electrodes of said driving element substrate, and wherein said recording element substrate, said driving element substrate, said ceiling plate, said first base plate and said second base plate are substantially composed of a same material.

2. An ink jet recording head according to claim 1, wherein said same material comprises at least one of aluminum, stainless alloy, and copper.

3. An ink jet recording head according to claim 1, wherein each of the ink oaths has a side wall portion and the side wall portions of the ink paths comprise a resin.

4. An ink jet recording head according to claim 1, wherein a plurality of discharge ports for discharging ink are arranged corresponding to a width of a recording medium used for recording.

5. An ink jet recording head according to claim 1, wherein said recording elements are electrothermal transducing elements for generating thermal energy.

6. A method for manufacturing an ink jet recording head comprising the steps of:

forming with a same material a recording element substrate having a plurality of discharge energy generating elements for generating energy utilized for discharging ink droplets and having a plurality of connecting electrodes respectively connected to the discharge energy generating elements and arranged on a surface of said recording element substrate, a driving element substrate having a plurality of driving elements to drive respectively said discharge energy generating elements and having a plurality of connecting electrodes respectively connected to the driving elements and arranged on a surface of said driving element substrate, a ceiling plate arranged on said recording element substrate having an ink chamber formed to retain ink in a plurality of ink paths corresponding to said plurality of discharge energy generating elements, a first base plate to hold said driving element substrate, and a second base plate to hold said recording element substrate;

laminating said second base plate, said recording element substrate, and a ceiling plate so as to allow said ceiling plate and said second base plate to nip said recording element substrate;

pressing said recording element substrate and said driving element substrate together so that said surface of said recording element substrate faces said surface of said driving element substrate, thereby connecting together in direct contact said connecting electrodes of said recording element substrate and said connecting electrodes of said driving element substrate; and forming a plurality of discharge ports for discharging ink by cutting said laminated second base plate, recording element substrate and ceiling plate together.

7. An ink jet recording apparatus comprising:

an ink jet recording head provided with a recording element substrate having a plurality of discharge energy generating elements for generating energy utilized for discharging ink droplets and having a plurality of connecting electrodes respectively connected to the discharge energy generating elements and arranged on a surface of said recording element substrate, a driving element substrate having a plurality of driving elements to drive respectively said discharge energy generating elements and having a plurality of connecting electrodes respectively connected to the driving elements and arranged on a surface of said driving element substrate, a ceiling plate arranged on said recording element substrate having an ink chamber formed to retain ink in a plurality of ink paths corresponding to said plurality of discharge energy generating elements, a first base plate to hold said driving element substrate, and a second base plate to hold said recording element substrate, said recording element substrate, said driving element substrate, said ceiling plate, said first base plate and said second base plate being substantially composed of a same material; and a mounting unit to mount the ink jet recording head, wherein said recording element substrate and said driving element substrate are pressed together such that said surface of said recording element substrate faces said surface of said driving element substrate, thereby connecting together in direct contact said connecting electrodes of said recording element substrate and said connecting electrodes of said driving element substrate.

8. An ink jet recording apparatus comprising:

an ink jet recording head provided with a recording element substrate having a plurality of recording elements and a plurality of connecting electrodes respectively connected to the recording elements, arranged on a surface thereof, a driving element substrate having a plurality of driving elements to drive respectively said recording elements and a plurality of connecting electrodes respectively connected to said driving elements, arranged on a surface thereof, a first base plate to hold said driving element substrate, and a second base plate to hold said recording element substrate, said recording element substrate and said driving element substrate being pressed together so as to connect together in direct contact said connecting electrodes of said recording element substrate and said connecting electrodes of said driving element substrate, wherein said recording element substrate, said driving element substrate, said first base plate and said second base plate are substantially composed of a same material; and a mounting unit to mount the ink jet recording head.

9. An ink jet recording apparatus according to claim 8, wherein a plurality of discharge ports for discharging ink are arranged corresponding to a width of a recording medium used for recording.

10. An ink jet recording apparatus according to claim 8, wherein said recording elements are electrothermal transducing elements for generating thermal energy.

* * * * *

UNITED STATES PATENT AND TRADEMARK OFFICE

CERTIFICATE OF CORRECTION

PATENT NO. : 6,113,214
DATED : June 3, 1996
INVENTOR(S) : Toshiaki Hirosawa et al.

It is certified that error appears in the above-identified patent and that said Letters Patent is hereby corrected as shown below:

Title page,
Item [54] and column 1, lines 5-6, "AND INK JET RECORDING APPARATUS" should be deleted.

Sheet 3, Figure 3,
Insert the attached amended Figure 3.

Sheet 5, Figure 8,
Insert the attached amended Figure 8.

Sheet 6, Figure 9,
Insert the attached amended Figure 9.

Column 3,
Line 44, "follow." should read -- follows. --.

Column 5,
Line 17, "la" should read -- 1 --; and "discharge." should read -- discharge --;
Line 41, "(Embodiment 3) With" should read -- (Embodiment 3) ¶ With --.

Column 6,
Line 17, "themselves" should be deleted.

Column 7,
Line 61, "rollers" should read -- roller --.

UNITED STATES PATENT AND TRADEMARK OFFICE

CERTIFICATE OF CORRECTION

PATENT NO. : 6,113,214
DATED : June 3, 1996
INVENTOR(S) : Toshiaki Hirosawa et al.

It is certified that error appears in the above-identified patent and that said Letters Patent is hereby corrected as shown below:

Column 9,
Line 12, "oaths" should read -- paths --.

Signed and Sealed this

Ninth Day of October, 2001

*Attest:*

Nicholas P. Godici

*Attesting Officer*

NICHOLAS P. GODICI
*Acting Director of the United States Patent and Trademark Office*